US005554023A

United States Patent [19]

Pustay

[11] Patent Number: 5,554,023

[45] Date of Patent: Sep. 10, 1996

[54] CANDLESTICK AND HOLDER

[75] Inventor: Laslo Pustay, West Winfield, N.Y.

[73] Assignee: Pustay Co., West Winfield, N.Y.

[21] Appl. No.: 314,882

[22] Filed: Sep. 29, 1994

[51] Int. Cl.[6] ..... F23D 3/16

[52] U.S. Cl. ..... 431/297; 431/789

[58] Field of Search ..... 431/297, 295, 431/292, 289

[56] References Cited

U.S. PATENT DOCUMENTS 2,057,943 10/1936 Friedrichs .
2,393,767 1/1946 Gould .
2,527,707 10/1950 Curtis ..... 431/297
2,689,470 9/1954 Turner .
3,767,355 10/1973 Anderson .

FOREIGN PATENT DOCUMENTS 25987 of 1899 United Kingdom ..... 431/297
26176 of 1903 United Kingdom ..... 431/297

*Primary Examiner*—Carroll B. Dority
*Attorney, Agent, or Firm*—Robert O. Wright

[57] ABSTRACT

A method of making a multiple piece candlestick having the appearance of a solid candlestick is shown. The candlestick has a reverse double taper candle well for securely holding a candle in a precise vertical position.

10 Claims, 1 Drawing Sheet

CANDLESTICK AND HOLDER

This invention relates to candle holders and more particularly to holders that will securely hold a candle vertical and centered in the holder until it is consumed.

BACKGROUND OF INVENTION

The lower end of a candle has generally been tapered so as to fit into a variety of sizes of holders and to also center the candle in the holder which usually has a cylindrical straight cut well. In practice only a limited range of sizes of ends will fit a given size well and even then the end may be easily damaged allowing the candle to tilt when inserted into the holder with the consequent mess and fire hazard. Even when the bottom end of the candle is tapered the same problems are encountered.

Wrapping with paper has been practiced for years while others have provided a resilient cup such as shown in U.S. Pat. No. 2,689,470 to Turner or a series of different sized cups that will fit on a candlestick as shown in U.S. Pat. No. 2,057,943 to Friedrichs. Both of these have required an auxiliary device sized to fit a particular candle end.

Other efforts have been directed toward trimming the end of the candle as it is inserted into the holder as shown in U.S. Pat. No. 2,393,767 to Gould. Anderson in U.S. Pat. No. 3,767,355 shows four triangular wedges in the bottom of the holder well which will tend to center the candle end in the holder but rely on cutting into the sides of the candle end to secure it in the holder. This obviously limits the number of times a candle can be inserted into Anderson's holder and tends to destroy the candle for use in any other holders. Since candles are frequently removed and reinserted into different holders this altering of the candle end has not been widely adopted.

OBJECTS AND SUMMARY OF INVENTION

Accordingly is an object of the present invention to provide a candle holder that overcomes the limitations of the prior art.

It is another object of the present invention to provide a candle holder that does not require auxiliary devices to fit the candle lower end into a holder.

It is another object of the present invention to provide a candle holder that will accommodate a variety of sizes of candle lower ends both straight and tapered.

It is another object of the present invention to provide a method of making a candlestick and holder that is economical to manufacture while providing a superior aesthetically pleasing appearance.

It is a still further object of the present invention to provide a candle holder that not only firmly grips the lower end of the candle but also provides an aligning support spaced upwardly from the bottom of the candle well to help keep the candle in a vertical position.

It is yet another object of the present invention to provide a candle holder that firmly grips the bottom of a candle whether straight or tapered without destroying it so that the candle can be removed and reinserted a number of times.

These and other and further objects are obtained in one embodiment of the invention in which a candlestick and holder are made of a number of pieces of solid material held together by threaded studs and in which the candle well of the holder is a truncated double cone having its largest diameter intermediate the open end and the bottom of the well.

DESCRIPTION OF A PREFERRED EMBODIMENT

Figure 1:
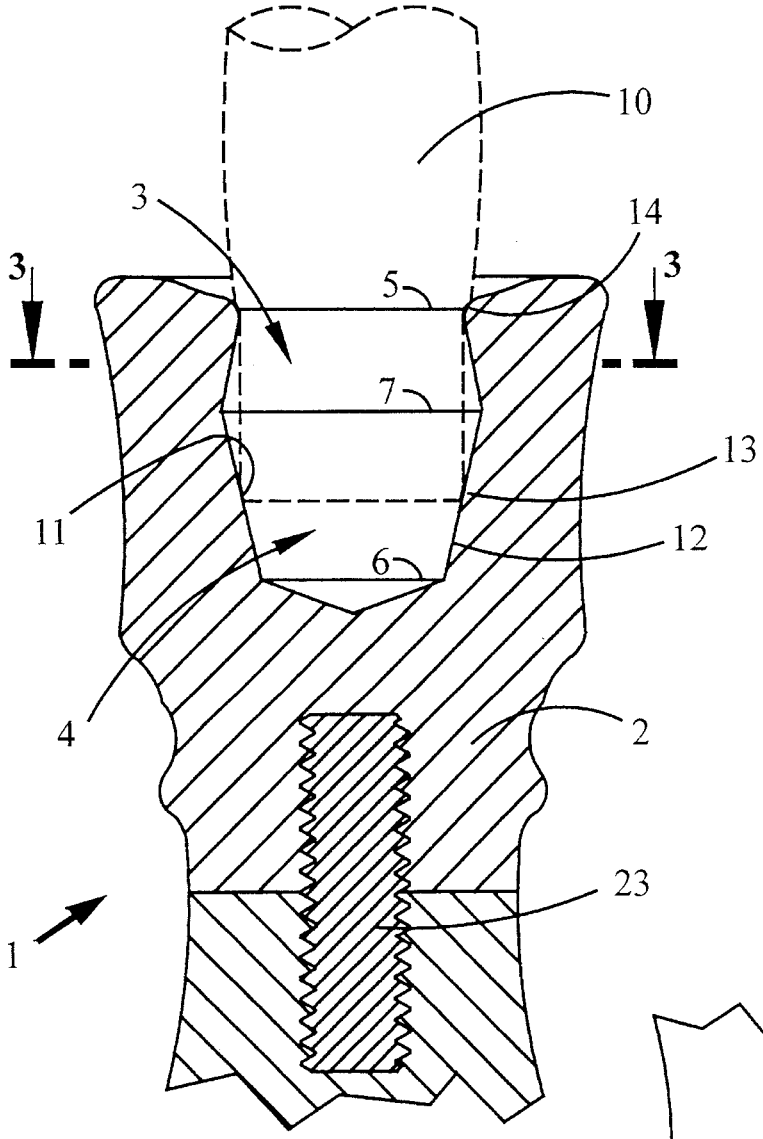
FIG. 1 is a sectional view of the upper end of a candlestick and holder according to the present invention with as candle shown in dotted lines for the sake of clarity.

Referring now to FIG. 1 there is shown the upper end of a candlestick 1 and candle holder well 2 according to the present invention. Well 2 is in effect a pair of truncated cones 3 and 4 with the lower cone 4 inverted and supporting on its base the upper cone 3. As can be seen, the base diameters 7 are equal while the diameter 5 of the open top of truncated cone 3 is larger than the diameter 6 of the inverted bottom cone 4. Obviously the base diameters 7 are larger than either top diameter 5 or 6.

Figure 3:
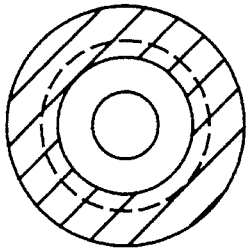
FIG. 3 is a cross sectional view taken on line 3—3 of FIG. 1.

The cones 3 and 4 as may be seen in FIGS. 1 and 3 form a generally cylindrical receptcle into which the lower end of a candle 10 can be inserted. To properly support the candle 10 in well 2 the candle end must be inserted far enough into well 2 so that the bottom 11 is wedged into the tapered portion 12 of the bottom cone 4 at 13. At the same time the lip 14 of the open top of cone 3 will support the side of the candle. The taper of cone 4 will center the candle bottom and also automatically tend to position the candle in a vertical position. Preferably lip 14 will have a diameter slightly larger than the diameter of the candle, for ease of insertion, but not so large as to allow the candle to tilt a noticeable amount should the bottom end move in the taper of cone 4.

In the case where the candle bottom is larger in diameter than the lip diameter 5, the lip is provided with a small diameter radius that permits the lip 14 to act as a trimming orifice to scrape off enough wax from the candle to allow it to be inserted into the well 2. The radius is small enough to scrape off the excess wax but not sharp enough to cut a persons finger. Once the candle end is inserted past the lip 14 the outward taper of cone 3 provides a clearance so that no further drag or resistance is encountered during insertion. This clearance also assists in aligning the candle for insertion by allowing a slight tipping of the candle. As may be seen in FIG. 1, this forms a straight portion on the candle surface which remains in contact with the lip as the bottom is inserted down into the well 2 until seated in the taper 12 of cone 4. The underside of the larger diameter candle forms with the lip 14 and taper 12 three areas of support firmly securing the candle in the holder 2 in a perfect vertical position.

Thus in the case where the candle is larger than the orifice of lip 14 the candle is held securely in the vertical position. In the case where the orifice of lip 14 is slightly larger than the diameter of the candle, lip 14 can still provide support with minimal tilt so as to be virtually unnoticeable. Applicant has found that the diameter of lip 14 can be up to one eighth of an inch greater than the diameter of the candle without allowing an undesirable amount of tilt. Similarly it has been found that, while the particular candle material is a factor, the diameter of the candle can be as much as one eighth to one quarter of an inch larger than the diameter 5 of lip 14 and still permit easy insertion.

While a straight candle bottom has been shown in FIG. 1, a tapered bottom candle can be inserted in holder 2 with similar advantageous results. Where the straight or tapered bottom is larger in diameter it will be shaved to fit and provide the three point support as above. In the case where the straight bottom is smaller, taper 12 of the bottom cone 4 will still hold the candle in the vertical position as long as the candle bottom diameter is larger than diameter 6. Lip 14 will also support the straight candle as indicated above.

Figure 4:
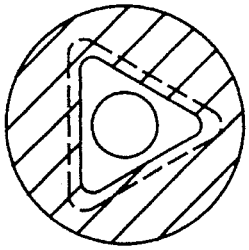
FIG. 4 is a view similar to FIG. 3 of another embodiment of the present invention.

Since the vast majority of candles, particularly the so called dinner candles, are round in cross section a cylindrical well has been shown and described as the preferred embodiment. It has been found however that a well having a polygonal cross section will work, provided the polygonal cross section forms an effective, although discontinuous, circle of support. Thus as shown in FIG. 4 a well having a triangular cross section will work. In this case the cones 3 and 4 become truncated pyramids. The actual number of sides is immaterial as long as a "circle of support" is provided to the bottom of the candle, and at the lip.

Figure 2:
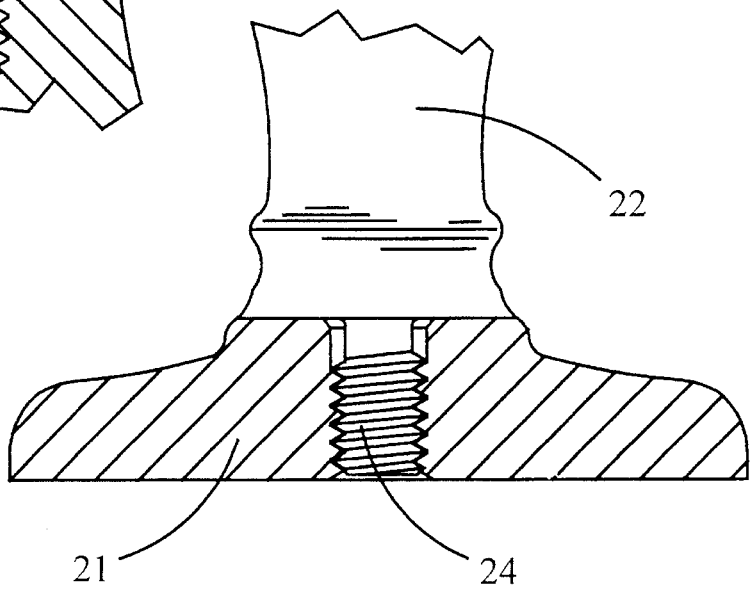
FIG. 2 is a sectional view of the lower end and base of a candlestick according to the present invention.

Referring now to FIGS. 1 and 2 there is shown a candlestick made from several pieces of solid bar stock such as brass or aluminum. According to the present invention these candlesticks comprise a holder member 2, a base member 21 and one or more intermediate members 22. These members are turned from round bar stock on a lathe and then joined together in axial alignment by threaded studs 23 and 24 which are securely tightened in threaded holes formed in the respective members. The individual members are securely tightened together to form a single piece in effect and then polished to give the appearance of a solid piece of metal without the expense and difficulty of machining the candlestick from a solid bar. A heavy, extremely stable, yet aesthetically pleasing candlestick is thus obtained.

Stud 23 is shown as a separate threaded rod and stud 24 is shown as an integral extension of the lower intermediate member 22. In one embodiment the threaded hole in base member 21 extends all the way through base member 21 and stud 24 has a length sufficient so that the end is flush with the underside of base member 21. The end of stud 24 is polished and the makers mark imprinted thereon.

While this invention has been explained with reference to the structures disclosed herein, it is not confined to the details as set forth and this application is intended to cover any modifications and changes as may come within the scope of the following claims.

What is claimed is:

1. A candle holder adapted to receive therein the bottom end of candles both straight and tapered which comprises:

a cylindraform candle well having a first top diameter, a second bottom diameter, and a third intermediate diameter;

said first top diameter being smaller than said third intermediate diameter but larger than said second bottom diameter.

2. A candle holder as claimed in claim 1 wherein said well is at least as deep as the length of said first top diameter.

3. A candle holder as claimed in claim 1 wherein said first top diameter is between one eighth inch to one quarter inch larger than said second bottom diameter.

4. A candle holder as claimed in claim 1 wherein said well forms a pair of truncated cones with the lower cone inverted and mating at its base with the upper cone base at said third intermediate diameter.

5. A candle holder as claimed in claim 1 wherein a lip is formed about the circumference of said first top diameter;

said first diameter is slightly smaller than the diameter of the candle to be inserted therein; and a small radius is formed on the inner edge of said lip;

whereby said lip can serve as a trimming orifice for a candle without cutting the fingers of a user of said candle holder.

6. A candle holder adapted to receive therein the bottom end of candles both straight and tapered which comprises:

a generally vertical candle well having a plurality of inwardly projecting surfaces forming in effect a polygonal horizontal cross section recepticle;

said recepticle cross section varying in cross sectional area from top to bottom of said well;

said cross sectional area at the top being greater than the cross sectional area at the bottom and less than the cross sectional area at an intermediate part of said candle well.

7. A candle holder as claimed in claim 6 wherein said plurality of inwardly projecting surfaces comprise three and said polygonal cross section is a triangle.

8. A candle holder as claimed in claim 6 wherein said plurality of inwardly projecting surfaces cooperate to form a series of points of contact with a cylindrical candle placed therein which points lie generally in the circumference of a circle.

9. A candle holding device for receiving the lower end of a candle and securely holding the candle in a vertical position which comprises:

a vertical well portion open at the top and extending downwardly to a bottom;

said well portion having a generally circular cross section of varying diameter from top to bottom;

a well mouth adjacent the top of the well portion having a first diameter;

the upper wall of said well tapering outwardly in reverse fashion from said mouth to a second larger diameter at a point between the top and bottom of said well portion;

the lower wall of said well tapering inwardly form said second diameter to adjacent the bottom thereof to form a candle end receiving seat.

10. A candle holding device as claimed in claim 9 wherein said well mouth has a diameter slightly less than the candle to be inserted therein and an inwardly extending annular lip forming an orifice through which the lower end of the candle must pass to be seated in said well;

said lip having a small enough radius edge so as to act to size the lower end of the candle for seating in the inwardly tapering lower wall portion as it passes therethrough; and said lip also acting to support an inserted candle in a vertical position when the bottom is seated in said lower wall portion.

* * * * *